US007712159B2

(12) United States Patent
Stringer et al.

(10) Patent No.: US 7,712,159 B2
(45) Date of Patent: May 11, 2010

(54) CONVERTIBLE POTTY CHAIR AND URINAL TRAINING DEVICE

(76) Inventors: Theory Stringer, 507 Katherwood, Deltona, FL (US) 32738; Theartis Perry, Sr., 1670 Mullet Lake Rd., Geneva, FL (US) 32738

( * ) Notice: Subject to any disclaimer, the term of this patent is extended or adjusted under 35 U.S.C. 154(b) by 938 days.

(21) Appl. No.: 11/465,053

(22) Filed: Aug. 16, 2006

(65) Prior Publication Data

US 2007/0039090 A1 Feb. 22, 2007

Related U.S. Application Data

(60) Provisional application No. 60/708,553, filed on Aug. 16, 2005.

(51) Int. Cl.
*A47K 11/04* (2006.01)

(52) U.S. Cl. ..... 4/483; 4/902; 4/239

(58) Field of Classification Search ..... 4/483, 4/484, 239, 902

See application file for complete search history.

(56) References Cited

U.S. PATENT DOCUMENTS 2,612,210 A * 9/1952 Light ..... 4/483
2,923,950 A * 2/1960 Carter ..... 4/483
3,343,179 A * 9/1967 Sellars Jr., et al. ..... 4/483
D351,224 S * 10/1994 Wise et al. ..... D23/296
5,685,029 A * 11/1997 Gee ..... 4/483
5,778,460 A * 7/1998 Doell et al. ..... 4/239
5,978,976 A * 11/1999 Chai ..... 4/483
6,341,386 B1 * 1/2002 Phillips et al. ..... 4/484

* cited by examiner

*Primary Examiner*—Khoa D Huynh

(57) ABSTRACT

A potty training device for male and female toddlers that is adaptable to be used as a training urinal for male toddlers. The convertible potty and urinal training device can be used the same way as conventional training potties but, in addition and unlike conventional training potties, is easily converted to a training urinal to train male toddlers to urinate in the standing position. This invention is comprised of a front, back, and side walls on a base with legs having a opening in the floor center. A removable waste container is mounted beneath the base for collecting waste making it adaptable to be used as a urinal for male toddlers. A removable seat with a opening in its bottom section is mated on the top and side brims of the urinal section making it adaptable to be used the same way as a conventional training potty.

1 Claim, 8 Drawing Sheets

Rear View of Potty/Urinal

Front View Of Seat

Separated from Urinal

Rear View of Seat

Separated from Urinal

Front View

*Urinal & Seat Separated*

Front View Seat & Urinal

*being mated*

CONVERTIBLE POTTY CHAIR AND URINAL TRAINING DEVICE

RELATED APPLICATIONS

The present application is a continuation application of U.S. provisional patent application Ser. No. 60/708,553, filed Aug. 16, 2005, included by reference herein and for which benefit of the priority date is hereby claimed.

FIELD OF THE INVENTION

The present invention relates to male and female potty chairs and training device and, more particularly, to training male toddlers to urinate while standing with a male urinal.

BACKGROUND OF THE INVENTION

This invention relates generally to training potties. It also concerns a urinal device for use in training male toddlers to urinate while standing. Conventional training potties are designed to be used by both male and female toddlers in the seated position. They are typically lightweight and portable and plumbing free, having a base, an a seat for sitting, and a waste-receiving pot aligned beneath the opening in the seat providing access to the pot for elimination waste. Since traditionally potties were designed for male and female toddlers to use in the sitting position, their unisex design has not properly met the potty training needs of male toddlers. Since it is difficult for a male toddler to direct his urine into the potty from a seated position, a urine guard is added to the front edge of the seat's opening. The purpose of this urine shield is to deflect the stream of urine into the training potty's pot, but most urine shields are not effective. Traditionally male adults do not urinate sitting down, conventional potty training devices fail to train male toddlers to urinate the way they will be expected to as adults.

Traditionally potty chairs were designed for male and female toddlers to use in the sitting position. Their unisex design has been unaccommodating of male toddlers. These types of potty chair designs ignored the need of training young male toddlers to stand while urinating. Attempts were made by industry to help male toddlers by designing urinals for them. Attempts were also made to solve this problem by combining the potty chair and urinal into one toilet training device. For example, in U.S. Pat. No. 6,000,943 issued to loretta Dawson for "Training Urinal and Commode," and in U.S. Pat. No. 5,044,020 issued to David G. Lewandoski and Edward Guard for "Urinal For Convience And Training Juvenile Males." Another example is in U.S. Pat. No. 5,388,279 issued to Estelle B. Rasmussen.

Conventional potty training devices for male and females toddlers have ignored the need for training males to urinate in the standing position. Potty training devices for young male toddlers i.e. urinals, were designed in an attempt to meet this need, but they also created a need for parents with both male and female toddlers to buy two separate potty training devices, which is an added expense. There have been potty training devices that were designed to act as a potty training device for both male and female toddlers that also included a stand-up urinals for male toddlers, but some of them were un-sanitary due to the fact that the user often came in contact with the urine and were difficult to clean. Another problem was that some were complicated in design and expensive to make.

It is therefore an object of the invention to provide an improved training potty that encourages and facilitates its use by male toddlers who are learning to urinate while standing.

It is another object of the invention to provide an improved training potty that can be easily converted to a urinal for training male toddlers.

It is another object of the invention to provide a urinal that needs no plumbing, and able to be easily emptied of waste.

It is another object of the invention to provide an improved training potty that still may be used conventionally by male and female toddlers to relieve themselves while seated.

It is another object of the invention to an improved training potty that is inexpensive to manufacture, easily operated, hygienic, and virtually maintenance-free.

SUMMARY OF THE INVENTION

In accordance with the present invention, provides a training device adapted to be used as a training urinal for male toddlers. The Potty Chair and Urinal Training Device can be used much the same way as a conventions training potty for male and female toddlers, but in addition and unlike conventional potty trainers, it is readily converted to a training urinal to train male toddlers to urinate while standing up. The Potty Chair and Urinal Training Device consists of a urinal and a removable seat along with their elements. The urinal construction consists of a base with legs having a back wall, front wall, and sidewalls, and has an opening in the middle of its tapered floor through which waste passes into a waste collection pot aligned beneath the urinal. The waste collection pot can be readily pulled out and emptied and replaced as necessary. The outer side walls of the urinal has a recessed area on both sides used as handles to carry the Potty Chair and Urinal Training Device.

The removable seat construction consist of a base for sitting with a opening in the middle through which waste flow through. When the removable seat is attached to the urinal, it can be used as most conventional potty trainers by both male and female toddlers. When used as a conventional potty chair, the waste flows through the bottom of the seat and pass through the urinal, and through the opening in the bottom of the tapered urinal floor, and into the waste collection pot. The tops of the side walls of the seat are also arm rests for the toddler when he or she is seated, and the back wall of the seat is the back rest. The removable seat has a urine splash guard positioned at the front edge of the seat's opening to minimize urine from splashing when the seat is attached to the urinal section and a male toddler uses the Potty Chair and Urinal Training Device in the seated position. The removable seat is attached to the urinal by sliding the seat back flange of the seat over the brim of the back of the urinal, which allows the removable seat to rest on the sides and the front of the urinal. Now male or female toddlers can sit and use the Potty Chair and Urinal Training Device like a conventional potty chair, and when the removable seat is lifted off, the Potty Chair and Urinal Training Device becomes a training urinal for male toddlers who are old enough, and/or are able to stand to be trained to urinate in the standing position.

By virtue of the invention, there is thus provided a Potty Chair and Training device for both male and female toddlers which is readily convertible to a training urinal to train male toddlers to urinate in the standing position. Various other features, advantages and characteristics of the present invention will become apparent to one of ordinary skill in the art after a reading of the following specification.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
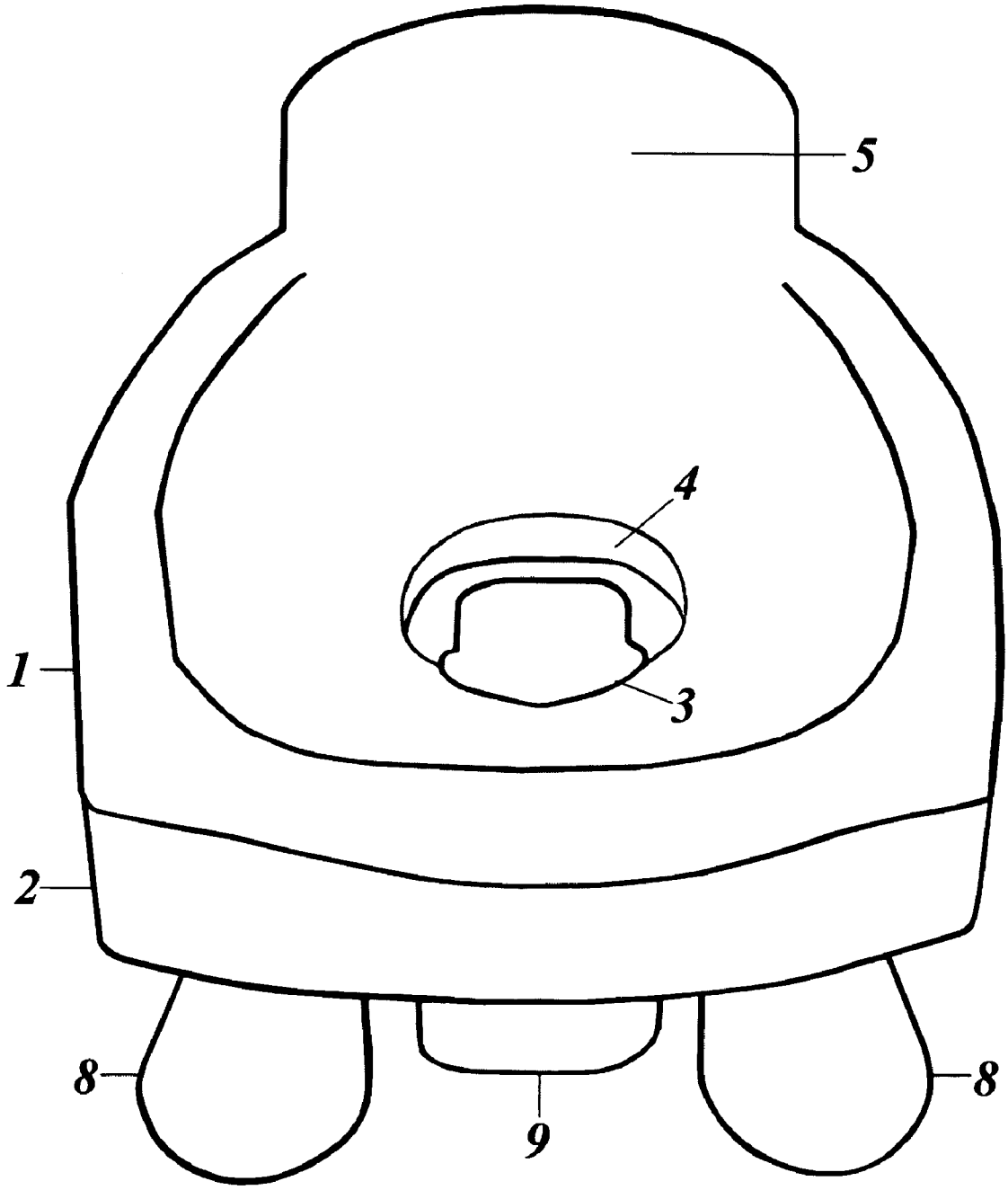
FIG. 1 is a front view of the seat section of the potty chair mounted on the urinal.

FIG. 1 is a front view of the Convertible Potty Chair and Urinal 2 Training Device showing removable seat 1 having seat waste cavity 4, an opening in the middle of removable seat 1 through which allows toddler's body waste to pass in route to waste collection pot 9. There is a urine splash guard 3 forward of the opening of removable seat 1 for directing a male toddler's urine into the potty from a seated position. The Logo placement area 5 is optional and is located on removable seat 1 on the back wall near top center. Removable seat 1 is designed to be positioned on top of urinal 2. There are four adjustable Legs 8, but not limited to four, that supports potty training device and are attached underneath urinal 2. Waste collection pot 9 is shown attached beneath urinal 2. Waste collection pot 9 is a round and/or deep container with a protruding brim in the front as a handle for inserting, removing waste collection pot 9 from attachment beneath urinal 2, as well as for handling waste collection pot 9. Waste collection pot 9 is aligned on a track beneath the front base of urinal 2 to catch waste matter i.e. urine and feces from toddlers. Waste collection pot 9 is inserted and removed for dumping waste by sliding it out on the track underneath the bottom front of urinal 2. With removable attached onto urinal 2, the convertable potty training device can be used as a conventional potty training device by male and female toddlers. The Convertible Potty Chair and Urinal 2 Training Device may be fabricated of fiberglass, plastic, or any other suitable material.

Figure 2:
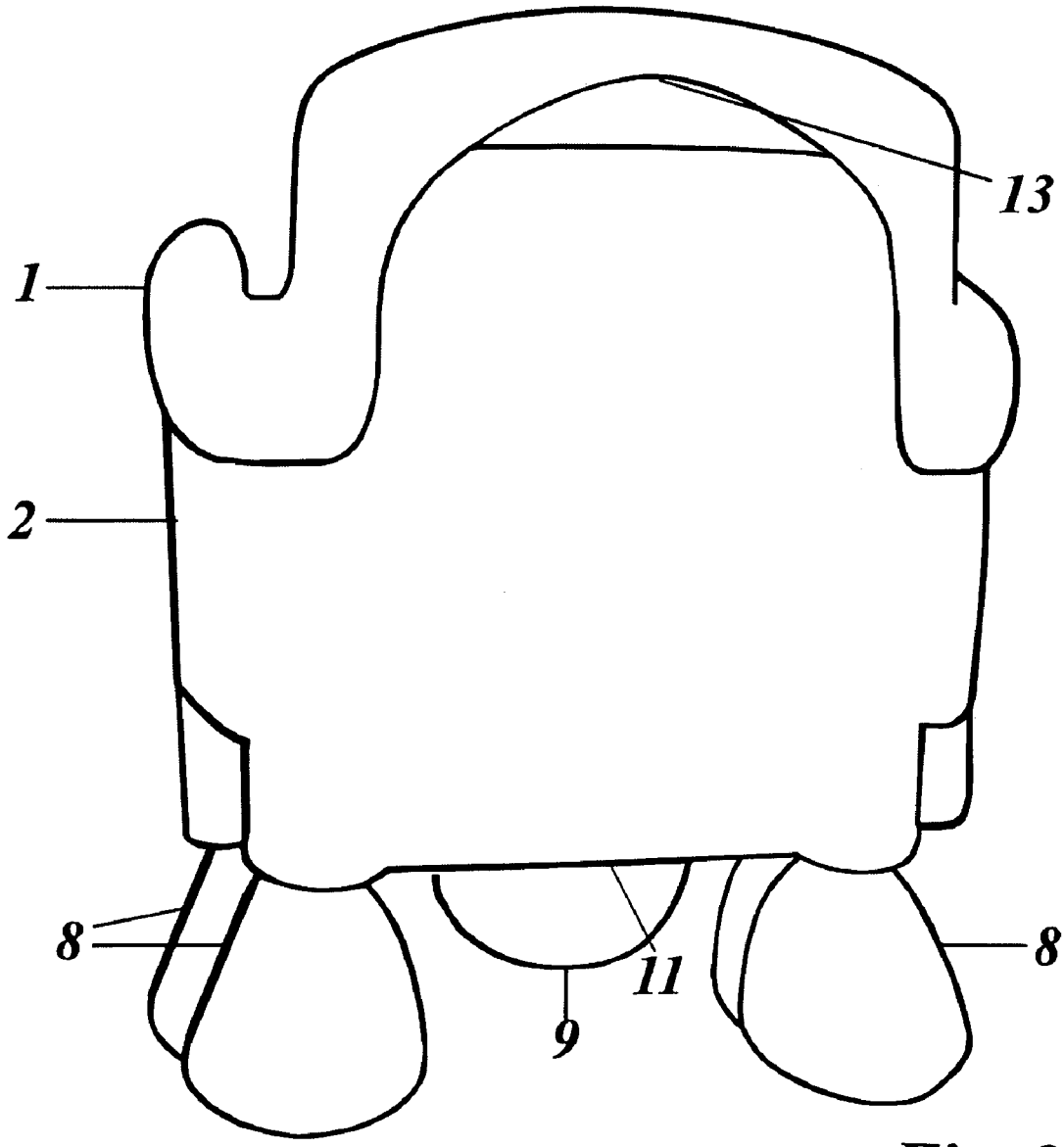
FIG. 2 is a rear view of the removable seat section of the potty chair mounted on the urinal.

FIG. 2 shows a rear view of the potty training device. The top section is the removable seat 1, with seat back track flange 15 that acts as a guide to slide the back of removable seat 1 over the back outside urinal wall 6, with the sides and front of removable seat 1, resting on and over-lapping the brim of inside urinal walls 12 and front urinal wall 13 securing removable seat 1 to urinal 2. Seat back track flange 15 is also used as a handle to lift and place removable seat 1 on to urinal 2. Urinal bottom flange 11 is the rim around the bottom of urinal 7 cavity shown in FIG. 7 that directs wastes into waste collection pot 9. The other reference numbers are explained in FIG. 1.

Figure 3:
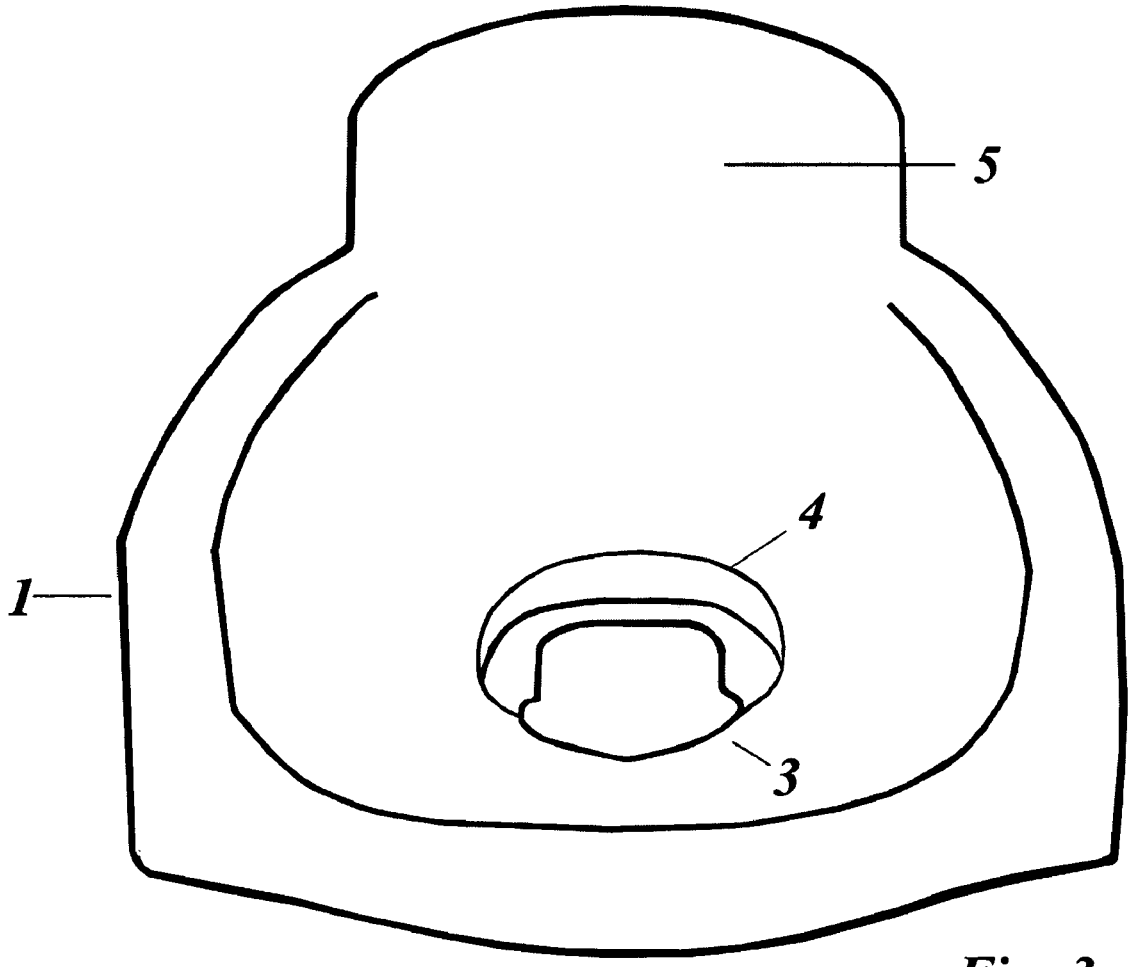
FIG. 3 is a front exploded view of the seat section of the potty chair.

FIG. 3 is a top exploded view of the front of removable seat 1, and is explained in FIG. 1.

Figure 4:
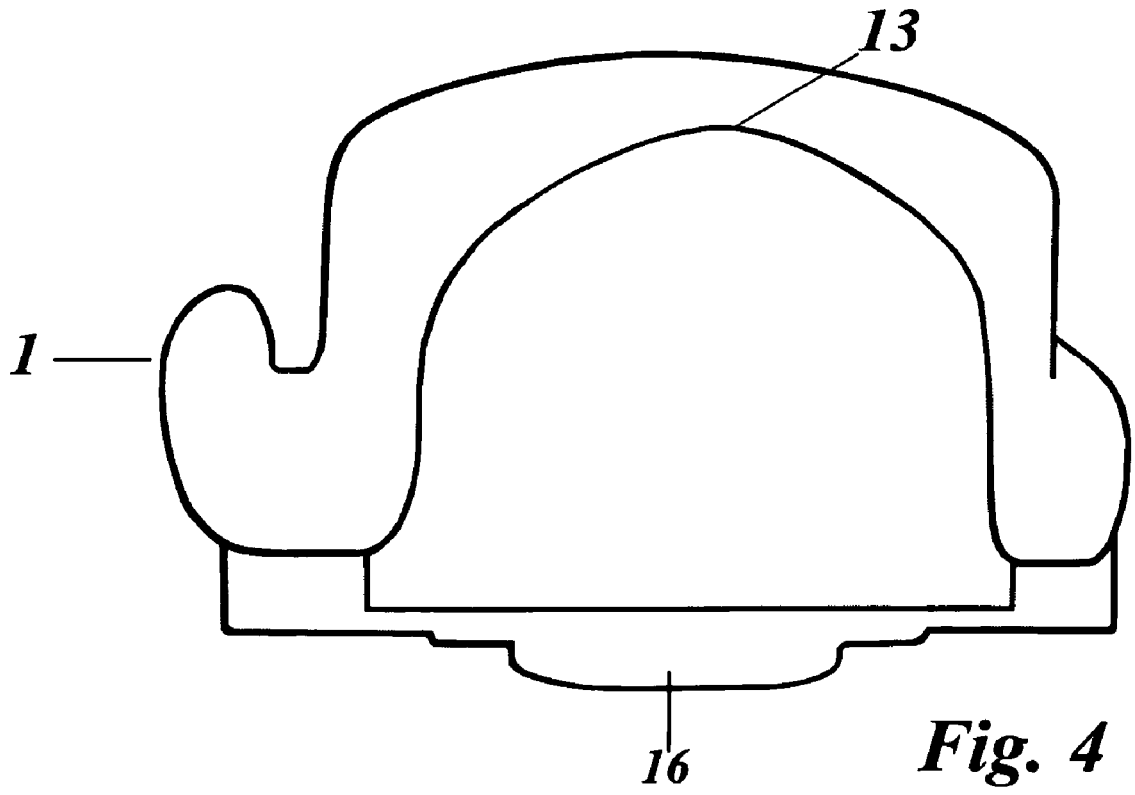
FIG. 4 is a rear view of the seat section of the convertible potty chair and urinal training device.

FIG. 4 shows the rear of removable seat 1. Seat cavity flange 16, which is a rim around the bottom of seat waste cavity 4 of removable seat 1, that allows waste to flow through into urinal 2, in route to waste collection pot 9. Other reference numbers explained in FIG. 2.

Figure 5:
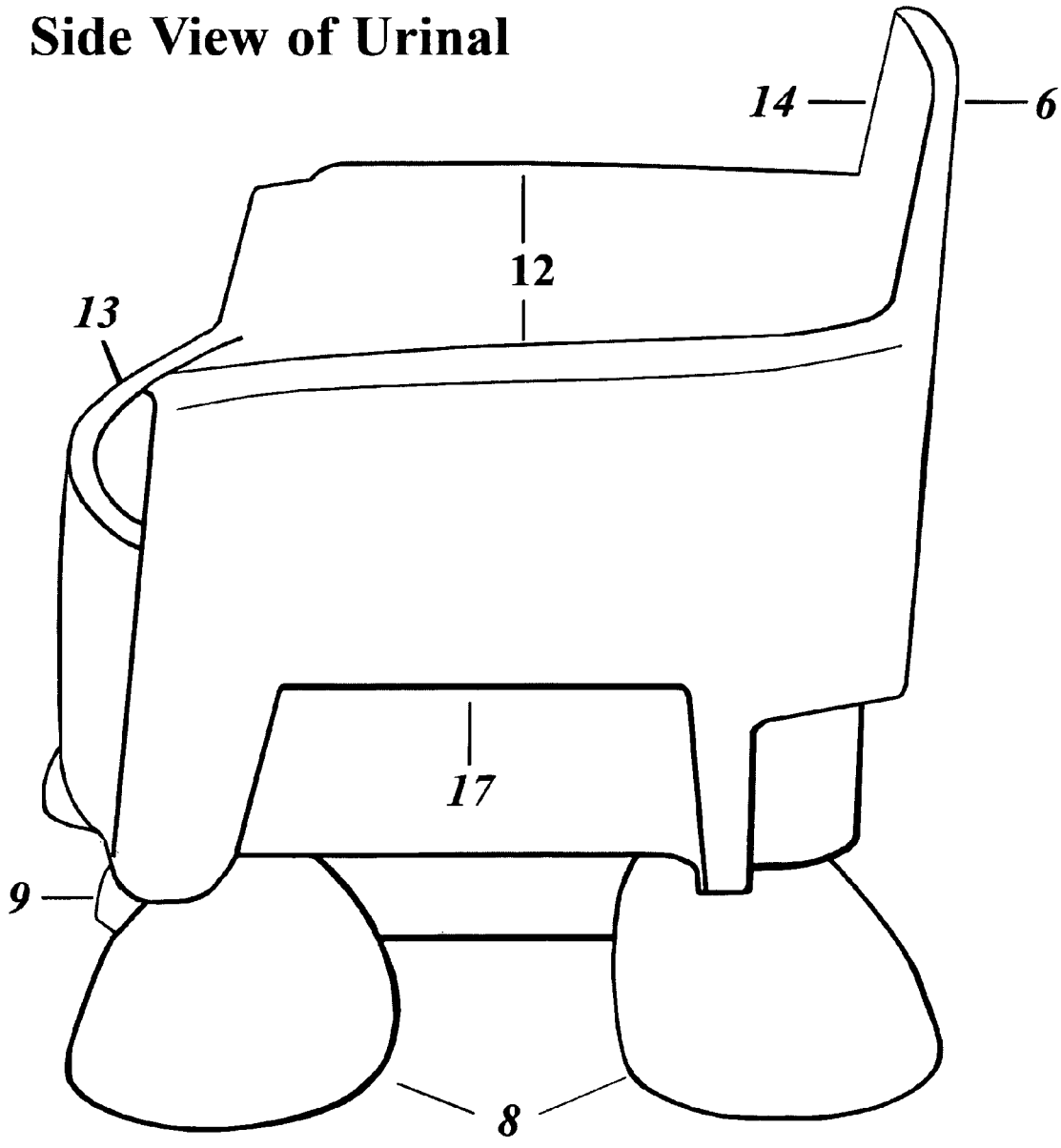
FIG. 5 is a side view view of a side view of the urinal of the convertible potty chair and urinal training device.

FIG. 5 shows side view of urinal 2. This potty training device can be converted into a urinal 2 to train male toddlers to urinate in the standing position by removing removable seat 1. By pulling up on the seat back track flange 15 and or the sides of removable seat 1, easily removes removable seat 1, from the base converting it into a urinal 2. FIG. 5 also shows inside urinal walls 12. When removable seat 1 is placed on urinal 2, it rests on, and is supported by inside urinal walls 12 brims, top brim of back inside urinal wall 14, the top brim of the back outside urinal wall 6, and front urinal wall 13. Urinal side handles 17 are recessed areas on the outside of urinal 2, and are used to lift urinal 2 as well as the entire potty chair when removable seat 1 is attached. Other reference number explained in FIGS. 1 & 2.

Figure 6:
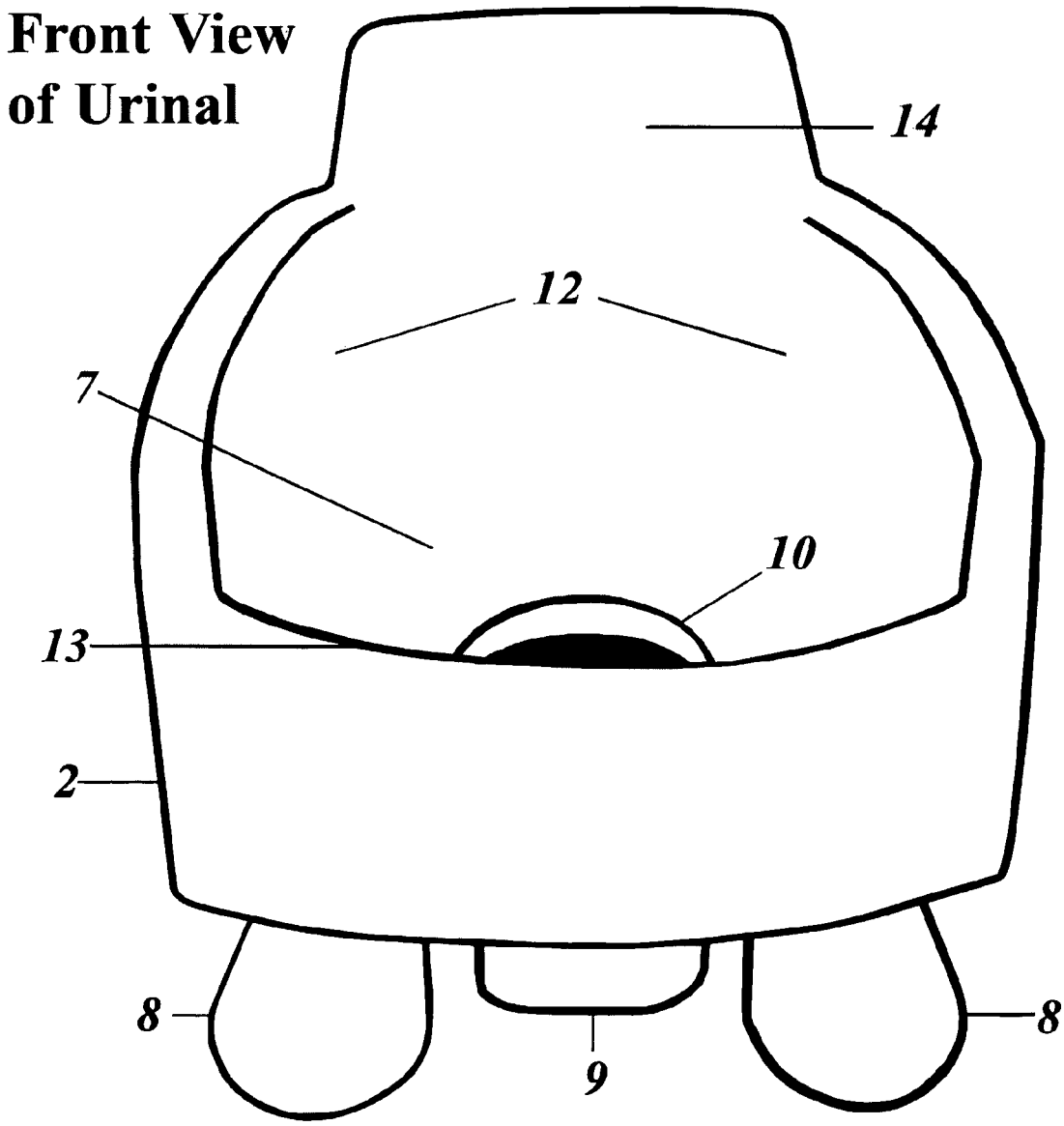
FIG. 6 is a front view of the urinal.

FIG. 6 shows front view of urinal 2. Reference numbers explained in FIGS. 1, 2 & 5.

Figure 7:
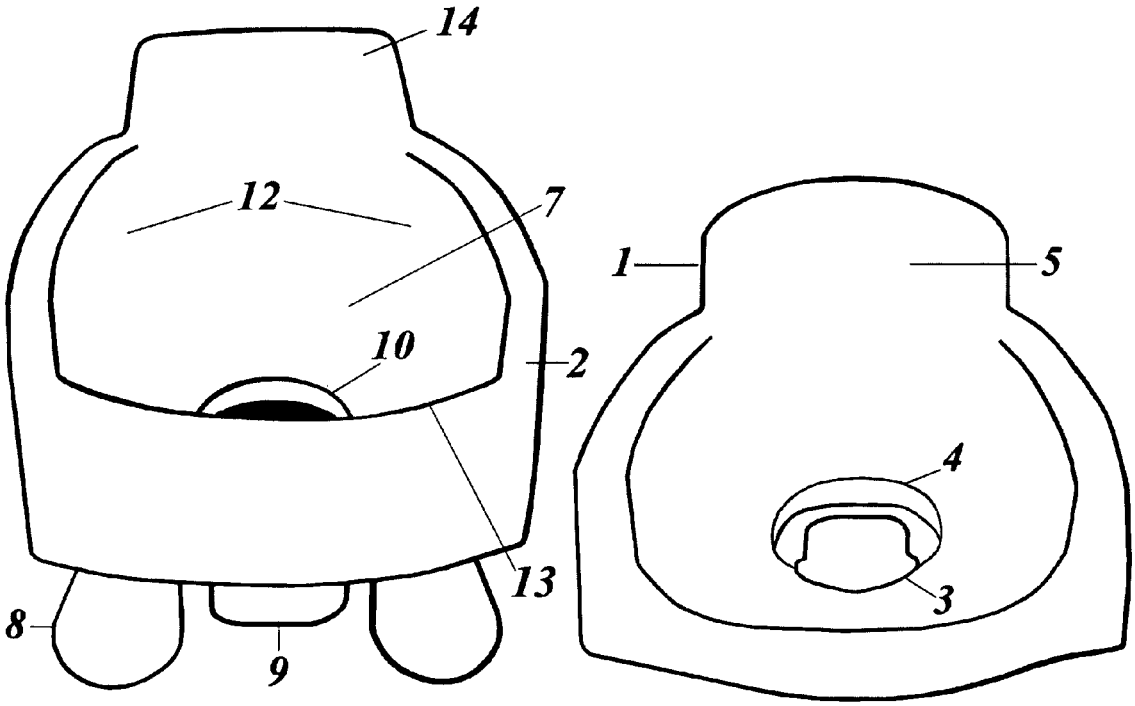
FIG. 7 is a front view of an urinal and seat section of the convertible potty chair and urinal training device with seat dismounted from urinal.

FIG. 7 shows urinal 2, with bottom of urinal 7, which is the floor of the urinal 2 which is slightly tapered down toward the center of the urinal 2 which allows body waste to slide through urinal cavity 10 into waste collection pot 9. Other reference numbers of urinal 2 are explained in FIGS. 1-6. FIG. 7 also shows removable seat 1, and its elements. All reference numbers are explained in FIG. 1-6. With removable seat 1 is removed, the potty training device is a urinal 2 for boy toddler to use as a stand-up trainer to urinate in the standing position.

Figure 8:
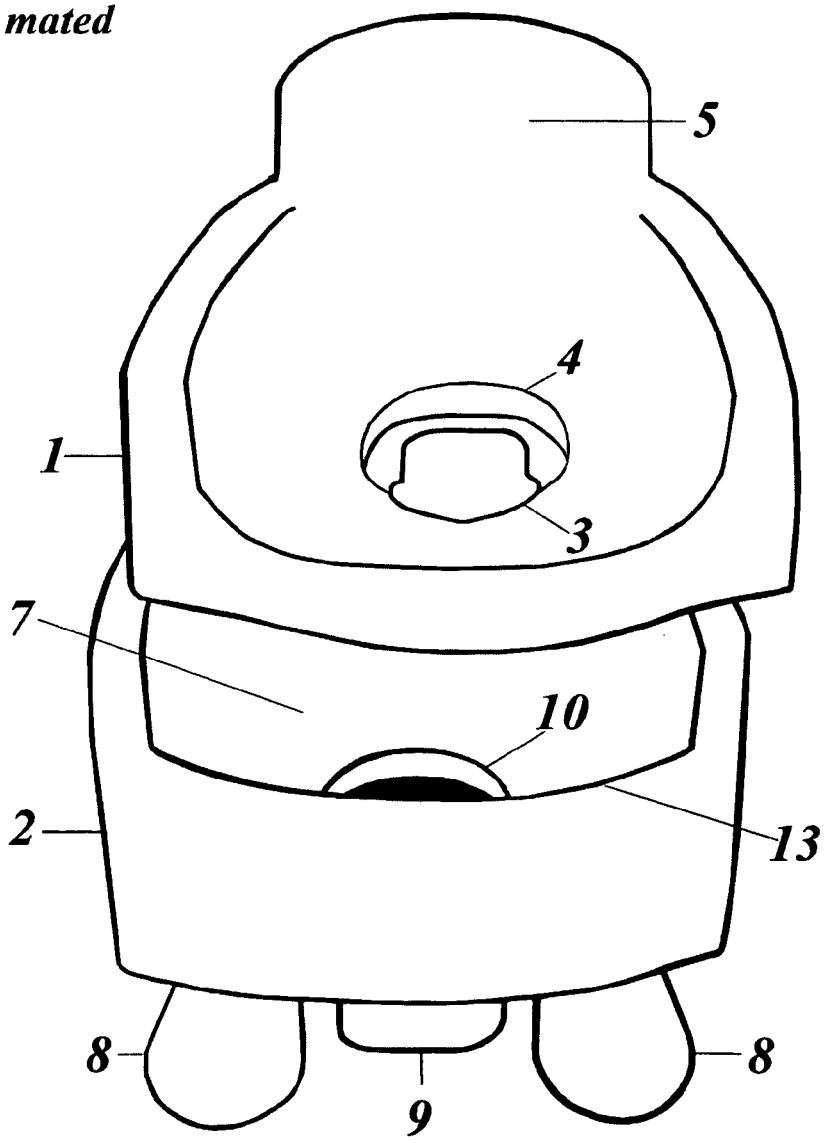
FIG. 8 is a front view of the potty chair being mated to the urinal section.

FIG. 8 shows removable seat 1 in the process of being mated onto urinal 2, converting it into a potty chair. Reference numbers explained in FIGS. 1-6.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A portable, convertible potty chair and urinal training device for training toddlers to use a toilet and for training male toddlers to urinate in a standing position, said portable, convertible potty chair and urinal training device comprising:

a urinal, said urinal comprising a plurality of legs for supporting said urinal on a floor, said plurality of legs removably attached underneath said urinal; a waste collection pot removably attached beneath said urinal, said waste collection pot having a protruding brim disposed in the front thereof, said protruding brim serves as a handle used for inserting and removing said waste collection pot from beneath said urinal, said waste collection pot is inserted and removed by sliding it out on a track which mounted underneath a bottom front of said urinal; said urinal further comprising urinal side walls, a back wall, a front wall, and a bottom wall; said urinal side walls, said back wall, said front wall, and said bottom wall together defined an internal cavity, said internal cavity having a tapered round hole formed in the center thereof, said bottom wall is tapered downwardly from said side walls toward the center of said urinal, said downwardly tapered bottom wall allows deposited waste to slide through said tapered round hole into said waste collection pot which is aligned directly underneath said tapered round hole; said urinal further comprising side handles that extend from said front wall toward said back wall, said side handles having recessed areas formed on the outside walls of said side handles for using to lift said urinal; said back wall having a back outside wall and a back inside wall; each of said urinal side walls having an outer side walls and an inner side wall; and a removable seat, said removable seat comprising seat side walls, a seat back, and a seat front portion; said removable seat further comprising seat arm rests extending from said seat front portion to said seat back; said removable seat is placed on said urinal for the toddlers to sit to relieve themselves of waste; said seat side walls, said seat back, and said seat front portion together defined a seat waste cavity; said seat waste cavity having a large opening formed in the center thereof; a seat cavity flange which is a rim around the bottom of said seat waste cavity; wherein deposited waste flows through said large opening, said seat cavity flange and into said waste collection pot of said urinal; said removable seat also includes a seat back track flange formed on the back side of said seat back, said seat back track flange is used for guiding and securing said removable seat to said back wall of said urinal and is also used as a handle to lift and place said removable seat onto said urinal; said urinal also includes a logo placement area disposed on the inner side of said seat back, and a urine splash guard disposed forward of the large opening for preventing the urine of male toddlers from splashing and directing urine into said waste collection pot;

wherein said seat back track flange is used to slide said seat back of said removable seat over said back inside wall of said urinal;

wherein said removable seat is designed to be positioned on top of said urinal for training toddlers to use the toilet from a seated position in such a manner that said seat side walls, said seat arm rests, said seat front portion and said seat back of said removable seat resting on and completely over-lapping said inner side walls, said side handles, said front wall and said back wall of said urinal;

wherein when said removable seat is removed from said urinal, said urinal is being converted and used for training male toddlers to urinate in the standing position;

wherein said back inside wall of said urinal is used for deflecting urine into said waste collection pot and for supporting said seat back of said removable seat;

wherein said inner side walls of said urinal are also used for deflecting and directing urine into said waste collection pot, and tops of said inner side walls of said urinal support the seat side walls of said removable seat;

wherein said front wall of said urinal is used for preventing waste from spilling onto the floor and is used as a base for supporting said seat front section of said removable seat when said removable seat is positioned on top of said urinal.

* * * * *